US005738283A

United States Patent [19]

Potz et al.

[11] Patent Number: 5,738,283

[45] Date of Patent: Apr. 14, 1998

[54] FUEL INJECTION VALVE FOR INTERNAL COMBUSTION ENGINES

[75] Inventors: Detlev Potz, Stuttgart; Guenter Lewentz, Hemmingen; Uwe Gordon, Markgroeningen; Stefan Haug, Leinfelden-Echterdingen; Christian Schmeisser, Esslingen, all of Germany

[73] Assignee: Robert Bosch GmbH, Stuttgart, Germany

[21] Appl. No.: 723,412

[22] Filed: Sep. 30, 1996

[30] Foreign Application Priority Data

Sep. 29, 1995 [DE] Germany ..... 195 36 330.2

[51] Int. Cl.[6] ..... F02M 47/00; B05B 1/30

[52] U.S. Cl. ..... 239/533.3; 239/533.13

[58] Field of Search ..... 239/533.3, 533.9, 239/533.13, 533.14, 602

[56] References Cited

U.S. PATENT DOCUMENTS 3,282,513 11/1966 Savage ..... 239/533.13

4,046,322 9/1977 Knape et al. ..... 239/533.13 X

FOREIGN PATENT DOCUMENTS

4023222A1 9/1991 Germany .

*Primary Examiner*—Lesley D. Morris
*Assistant Examiner*—David Deal
*Attorney, Agent, or Firm*—Edwin E. Greigg; Ronald E. Greigg

[57] ABSTRACT

The invention sets forth a fuel injection valve for internal combustion engines, having a valve body and an expansion sleeve that cooperates with the valve body. A pressure chamber is defined between the expansion sleeve and the valve body into which a high-pressure conduit discharges which can be made to communicate with an injection cross section into the combustion chamber of the engine via an opening cross section, openable at high pressure, between the expansion sleeve and the valve body. The cup-shaped expansion sleeve is slipped onto the circumferential jacket face of the valve body and braced axially against the valve body; a portion of the expansion sleeve is embodied as a fastening element on the valve body.

16 Claims, 3 Drawing Sheets

FUEL INJECTION VALVE FOR INTERNAL COMBUSTION ENGINES

BACKGROUND OF THE INVENTION

The invention is based on a fuel injection valve for internal combustion engines. In one such fuel injection valve, known from German Published Patent Application DE-OS 40 23 222 A1, a pressure chamber is defined between a valve body and a valve member inserted firmly into the bore of the valve body; the pressure chamber can be filled with fuel that is at high pressure via a high-pressure conduit provided in the valve body and the valve member. An opening cross section formed between the valve body and the valve member separates the pressure chamber from an injection cross section into the combustion chamber of the engine to be supplied. This opening cross section is opened only when pressure is exerted on the pressure chamber; to that end, the valve body is radially widened in this region, or alternatively the valve member is radially narrowed. The injection event is thus based on the elastic deformation of one of the components that enclose the pressure chamber, so that movable valve members can be dispensed with. However, the known fuel injection valve has the disadvantage that the injection cross section is embodied as an annular cross section, which does not enable a defined location of the injection stream. Moreover, the known injection valve is composed of many components, which means highly complicated manufacture and hence high production costs.

OBJECT AND SUMMARY OF THE INVENTION

The fuel injection valve for internal combustion engines according to the invention has the advantage over the prior art that the necessary components can be reduced to two individual parts, namely a valve body and an expansion sleeve cooperating with it; this makes production considerably less complicated and thus markedly lowers the production costs. By using a modular system, large numbers of a universal valve body and a universal expansion sleeve can be kept in inventory, and the various injection geometries can simply be provided on demand.

To that end, the expansion sleeve that executes the elastic opening motion is advantageously secured directly to the valve body, without using an additional fastener.

This can be done by positive, shape-dictated engagement by means of a thread, or by direct material engagement, for instance by welding; welding in particular has the advantage that despite a precise positional fixation of the expansion sleeve on the shaft of the valve body, only two components are necessary.

Alternatively, however, it is also possible for instance to press-fit or crimp-fit the expansion sleeve onto the valve body.

The expansion sleeve, preferably embodied in cup shape, which with its closed end covers the portion of the valve body that protrudes into the combustion chamber of the engine, moreover makes it possible to provide injection openings in the form of injection bores, by way of whose position and embodiment the position and embodiment of the injection streams can then be adapted to the requirements of the engine; different injection port lengths can be attained by way of different wall thicknesses of the expansion sleeve.

An angular dependency of the injection stream on the sleeve expansion can be precluded by maintaining a minimum spacing of the injection ports from the closed sleeve bottom, which can moreover be embodied in reinforced fashion to prevent sagging.

Another advantage is attained by overflow-oil-free construction of the injection valve, so that complicated overflow oil bores, connections and lines can be eliminated and the effort and expense of production and assembly can be reduced still further. Moreover, this makes it possible to dispose the high-pressure conduit centrally, which means higher pulsating compression fatigue strength in more-economical material and lower production costs.

The opening cross section is formed by a sealing edge, provided on the valve body, and a conical valve sealing face cooperating with it on the expansion sleeve; various alternatives are possible for forming the sealing edge. Since the encompassing sealing edge may also be disposed at a certain angle from the axis of the valve body, the injection valve of the invention is also suitable for being installed off center and obliquely the injection cross sections can then have different elevation angles.

Alternatively, it is also possible to provide the sealing edge on the inner wall of the expansion sleeve and to provide the conical valve seat on the jacket face of the valve body.

The embodiment of the opening cross section makes it possible in a simple way to adjust the opening pressure of the injection valve from the outside, by pressing the expansion sleeve elastically onto the valve body, by means of the conical valve sealing face, only far enough that a certain amount of radial contact-pressure force between the valve sealing face and the sealing edge is attained. In this position, the expansion sleeve is then fixed relative to the valve body, which can be done especially simply by welding.

To adjust various opening pressures, an adjusting shim can also be provided, which is fastened axially between the valve body and the expansion sleeve and which, when a screwed-on expansion sleeve is used, can easily be replaced for an adjusting shim of a different thickness. Depending on the cone angle of the valve sealing face, it is possible to assign various opening pressure values to various adjusting shim thicknesses.

Using adjusting shims also has the advantage that at the same time, they seal off the pressure chamber enclosed between the valve body shaft and the expansion sleeve.

The pressure chamber can be disposed on the closed bottom of the expansion sleeve or on its upper end, depending on the embodiment of the high-pressure conduit in the valve body; the pressure chamber is always separated from the injection openings by the opening cross section formed by the sealing edge and the valve sealing face.

Alternatively, the expansion sleeve may be embodied in such a way that the opening cross section is uncovered by an axial lengthening of the sleeve; to that end, a conical valve seat is provided on the sleeve bottom and cooperates directly with an annular edge formed at the outlet opening of the high-pressure conduit.

For the sake of reliably defining the stream location of the injected fuel into the combustion chamber, means are also provided that assure a secure circumferential positional fixation of the expansion sleeve that carries the injection ports or the injection cross section. These means may be embodied alternatively as groove guides, stops, or the like.

Further advantages and advantageous features of the subject of the invention may be learned from the specification, the drawing and the claims.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 2:
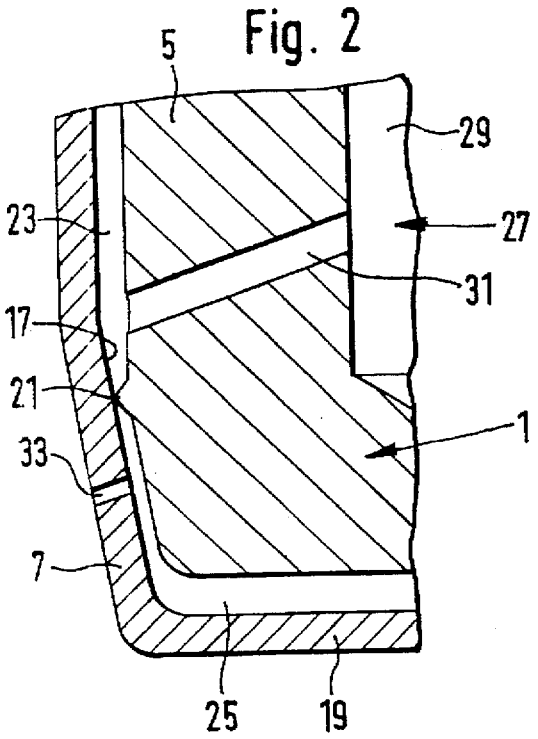
FIG. 2 is a partial view of an enlarged detail of FIG. 1 showing a first exemplary embodiment with a radially protruding sealing edge and a pressure chamber located at the top portion.
Figure 1:
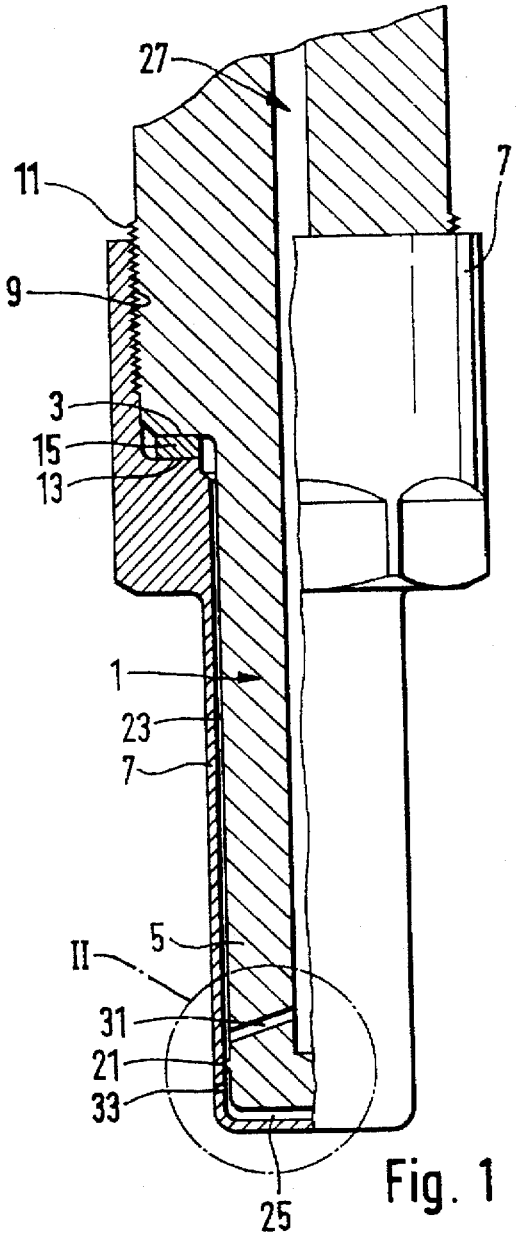
FIG. 1 shows a cross sectional view of the injection valve in longitudinal section.

The first exemplary embodiment, shown in FIGS. 1 and 2, of the fuel injection valve according to the invention for internal combustion engines has a cylindrical valve body 1, whose cross section decreases via an annular step 3 and which protrudes, by the free end of the smaller-diameter shaft part 5, into the combustion chamber, not shown, of the engine.

A cup-shaped expansion sleeve 7 which is made of a n expandable material is mounted on the valve body 1 in such a way that with its closed end it covers the free end toward the combustion chamber of the valve body 1; by means of an internal thread 9 it is screwed in the manner of a union nut onto an external thread 11 disposed in the larger-diameter part of the valve body 1. The expansion sleeve 7 has an annular shoulder 13, formed by an enlargement of the inner bore, that cooperates with the annular step 3 of the valve body 1 to form an axial counterpart stop; between the annular shoulder 13 and the annular step 3, an adjusting shim 15 is fastened in place, and the axial location of the expansion sleeve 7 on the valve body 1 can be adjusted via the thickness of this shim.

On its lower end, toward the combustion chamber, the expansion sleeve 7 has a conical reduction in diameter, shown on a larger scale in FIG. 2, which extends as far as the closed end face and thus in the interior of the expansion sleeve 7 forms a conical valve seat face 17 that extends as far as the bottom 19 of the expansion sleeve 7; the conical angle of the valve seat face 17 is very small but is shown larger in FIGS. 2–6 for the sake of clarity.

Cooperating with the valve seat face 17 is a circular sealing edge 21, that protrudes radially from the end of the shaft 5 of the valve body 1 toward the combustion chamber; in the exemplary embodiment, the sealing edge extends in the manner of a knife edge or blade, and the valve seat face rests elastically on it with a certain initial tension that is adjustable by the degree of axial insertion depth of the expansion sleeve 7 onto the valve body 1. This sealing edge 21 divides a pressure chamber 23, defined between the expansion sleeve 7 and the shaft 5 of the valve body 1, from an injection chamber 25 defined between the bottom 19 of the expansion sleeve 7 and the end toward the combustion chamber of the valve body 1; on its upper end toward the annular step 3, the pressure chamber 23 is sealed off by the adjusting shim 15 fastened there.

For supplying the fuel to be injected, a high-pressure conduit 27 is provided in the valve body 1; via a high-pressure line, not shown, it communicates with a high-pressure fuel pump, and in the first exemplary embodiment it is formed by an axial blind bore 29 originating at the upper end of the valve body i and by two crosswise bores 31 that intersects the blind bore. The crosswise bores 31, many of which may be provided, but at least one of which is provided, are inclined in the direction of fuel flow in the exemplary embodiment and discharge above the sealing edge 21 into the pressure chamber 23, which is located at the top in this exemplary embodiment. In the wall region of the expansion sleeve 7 adjoining the sealing edge 21 at the bottom, in the region of the injection chamber 25, injection bores 33 that form an injection cross section are also provided; they are shaped in accordance with the demand made of the injection stream, and once again many of them may be provided, distributed over the circumference of the expansion sleeve 7.

In order to minimize both the hydraulic compression volume upstream of the sealing edge 21 (idle volume) and the harmful volume, in terms of hydrocarbon emissions, downstream of the sealing edge 21 (harmful volume) of the injection chamber 25, the components are optimized accordingly.

Figure 3:
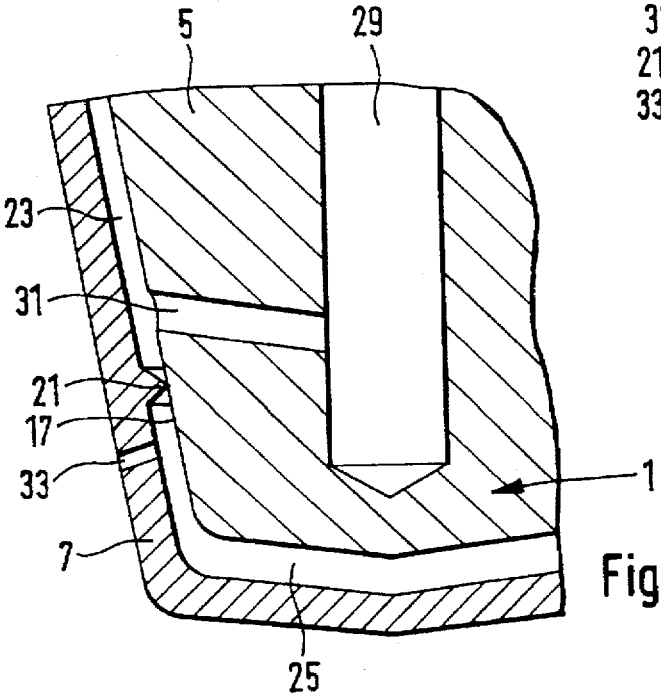
FIG. 3 shows a partial cross sectional view of a second exemplary embodiment, in which the sealing edge is disposed on the expansion sleeve.

The second exemplary embodiment shown in FIG. 3 differs from the first exemplary embodiment only in the disposition of the sealing edge 21, which is now disposed on the inner wall of the expansion sleeve 7 and cooperates with a conical valve seat face 17 provided on the jacket face of the valve body 1.

The fuel injection valve of the invention functions as follows:

During intervals between injections, the pressure chamber 23 is sealingly closed off from the injection chamber 25 by the elastic contact of the valve seat face 17 against the sealing edge 21.

At the onset of fuel injection, the fuel, which is at high pressure, flows through the high-pressure conduit 27 into the pressure chamber 23, where it builds up a high fuel pressure that consequently causes a radial widening of the expansion sleeve 7, which is made of an elastic material. The radial widening of the expansion sleeve 7 causes the conical valve seat face 17 to lift away from the sealing edge 21 of the valve body 1 and thus uncovers the opening cross section toward the injection chamber 25. The fuel then flows along the opening cross section into the injection chamber 25 and from there in a known manner passes via the injection bores 33 into the combustion chamber of the engine to be supplied. At the end of fuel injection, the pressure in the high-pressure conduit 27 and in the pressure chamber 23 drops below the necessary opening pressure, so that now the intrinsic tension of the expansion sleeve 7 suffices to push the valve seat face 17 against the sealing edge 21 and thus to close the opening cross section once again. The value of the opening pressure can be adjusted via the axial insertion depth of the expansion sleeve 7, as a function of the cone angle of the valve seat face 17 and the elasticity of the expansion sleeve 7.

Figure 4:
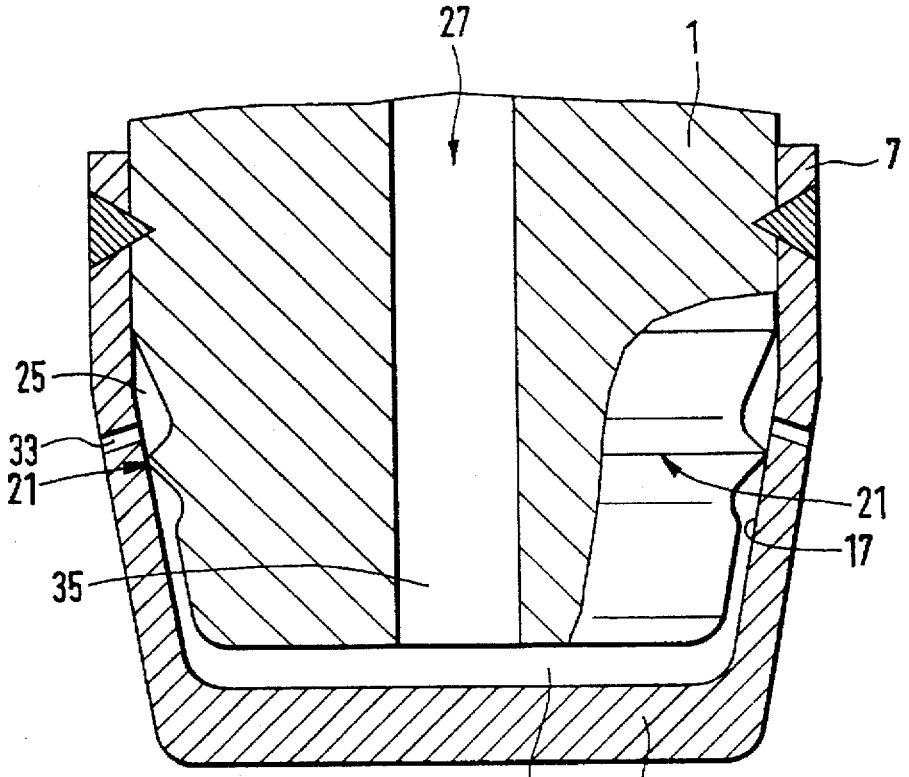
FIG. 4 shows a partial cross sectional view of a third exemplary embodiment with a radially protruding sealing edge and the pressure chamber at the bottom.

In the third exemplary embodiment, shown in FIG. 4 in a view similar to that of FIG. 2, the expansion sleeve 7 is embodied merely as a cap, which after being press-fitted onto a certain axial distance is sealingly welded to the sealing edge 1; thus the injection valve now comprises only two components. Analogously to the first exemplary embodiment, the expansion sleeve 7 has a conical valve seat face 17, which cooperates with a radially protruding sealing edge 21 of the valve body 1. The high-pressure conduit 27 is embodied in the second exemplary embodiment as an axial through bore which discharges into a pressure chamber 23, now located at the bottom and formed between the sleeve bottom 19 and the end face toward the combustion chamber of the valve body 1; analogously to FIG. 2, the pressure chamber 23 is separated from an injection chamber 25 located at the top by the sealing or opening cross section formed between the sealing edge 21 and the valve seat face 17; the injection bores 33 lead away from the injection chamber 25. The injection is effected as in the first exemplary embodiment by means of the radial widening of the expansion sleeve caused by the imposition of high fuel pressure; as a result, the valve seat face 17 lifts away from the sealing edge 21 and uncovers the opening cross section into the injection chamber 25, through which the fuel at high pressure is injected via the injection bores 33.

This version has the advantage that testing and adjusting of the opening pressure can be done during assembly, by press-fitting the sleeve on far enough that the desired opening pressure is attained. The sleeve 7 is then welded to the valve body 1 in that position.

Figure 5:
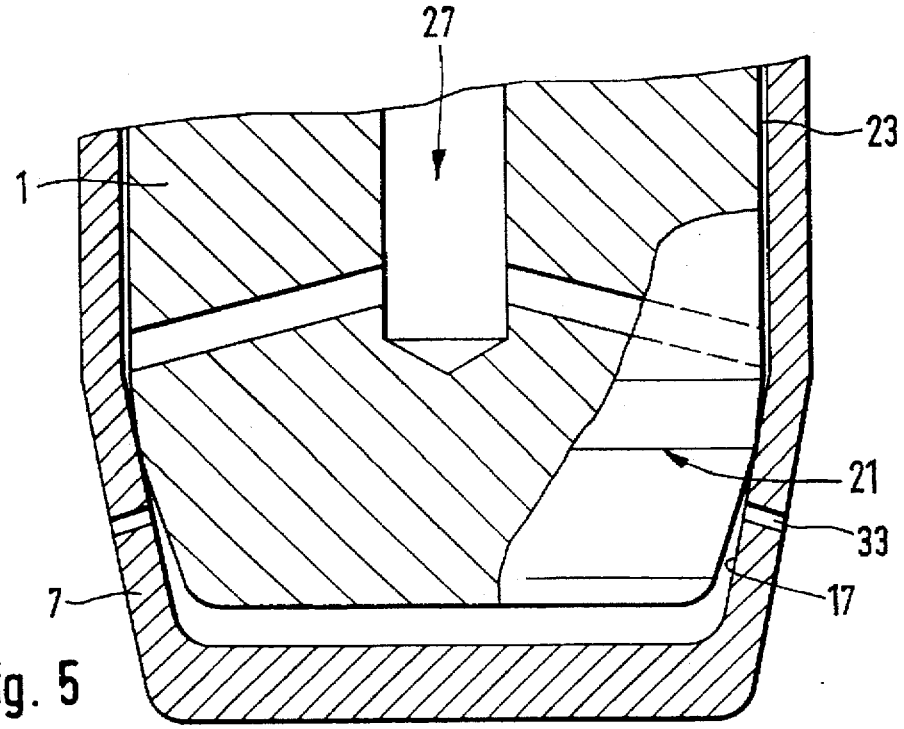
FIG. 5 shows a partial cross sectional view of a fourth exemplary embodiment, with a sealing edge formed by a conical cross-sectional reduction of the valve body.

The fourth exemplary embodiment shown in FIG. 5 differs from the first exemplary embodiment merely in the embodiment of the sealing edge 21 on the valve body 1 that cooperates with the valve seat face 17; this sealing edge is now formed by a conical reduction of cross section at the lower end of the valve body 1, which has the advantage of high strength and simple manufacture.

Figure 6:
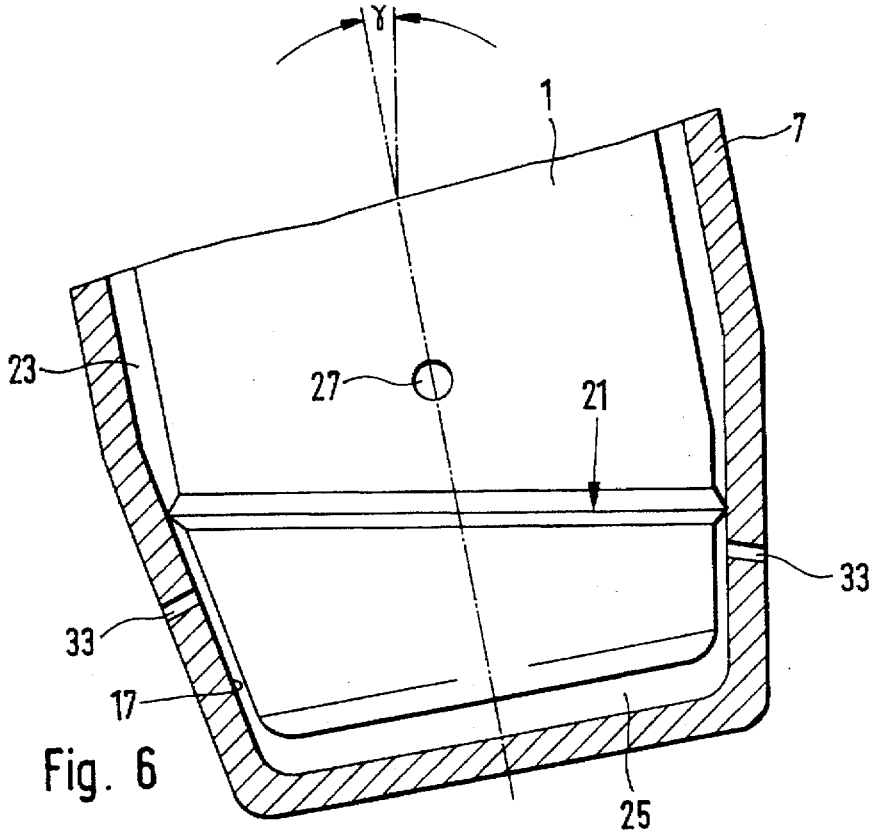
FIG. 6 shows a partial cross sectional view of a fifth exemplary embodiment with a sealing edge disposed obliquely to the valve body axis.

For an oblique installation of the fuel injection valve, the fifth exemplary embodiment shown in FIG. 6 has a sealing edge 21, protruding from the valve body 1 radially by an angle gamma that is inclined relative to the axis of the valve body 1 and the expansion sleeve 7; analogously to the first exemplary embodiment, the sealing edge 21 cooperates with a conical valve seat face 17 on the inner wall of the expansion sleeve 7, and the high-pressure fuel conduit 27, discharging into the pressure chamber 23, located at the top, is embodied analogously to FIGS. 1 and 2. The injection bores 33 disposed in the injection chamber 25 located on the bottom have various elevation angles, in a known manner.

Figure 7:
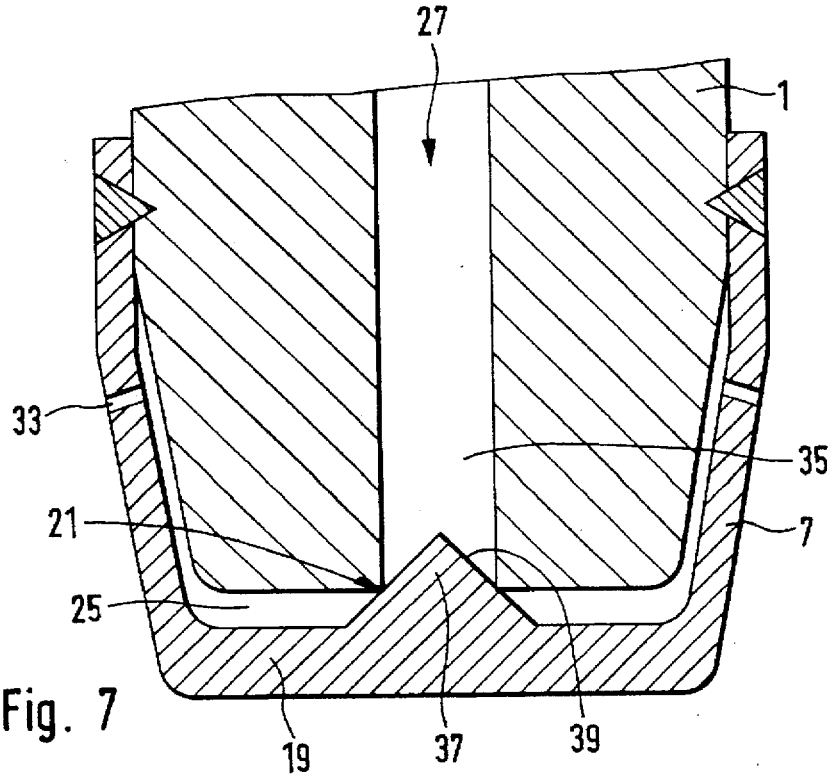
FIG. 7 shows a partial cross sectional view of a sixth exemplary embodiment, in which the valve seat face is formed by a conical feature formed onto the sleeve bottom that cooperates with an outlet opening of the high-pressure conduit.

The sixth exemplary embodiment, shown in FIG. 7, differs from the above exemplary embodiments basically in that the expansion motion of the expansion sleeve 7, which opens the opening cross section between the valve body 1 and the expansion sleeve 7, occurs not radially but rather in the axial direction.

To that end, the expansion sleeve 7, which analogously to FIG. 4 is welded to the valve body 1 (but alternatively may also be screwed on) has a conical face protuberance 37 on its closed bottom 19; the conical face of this protuberance forms a conical valve seat 39. Cooperating with this valve seat 39 is a sealing edge 21, formed at the outlet opening toward the combustion chamber of the axial through bore 35 that forms the high-pressure conduit 7, so that the high-pressure conduit 27, simultaneously acting as a pressure chamber, is connected sealingly against the injection chamber 25 enclosed between the valve body 1 and the expansion sleeve 7; the injection bores 33 lead away from this injection chamber in a known manner.

The injection event now takes place as a result of the axial deflection of the sleeve bottom 19 and thus of the valve seat 39 provided on it, so that the fuel flows out of the high-pressure conduit 27 along the opening cross section opened between the valve seat 39 and the sealing edge 21 into the injection chamber and on via the injection bores 33 into the combustion chamber of the engine.

With the fuel injection valve for internal combustion engines according to the invention it is thus possible to achieve a fuel injection valve in which the functions of opening, closing and sealing are integrated in one component and which requires no movable valve member, and this can be done in a structurally simple way with only a few components, thus enabling economical large-scale mass production of the injection valve.

The foregoing relates to preferred exemplary embodiments of the invention, it being understood that other variants and embodiments thereof are possible within the spirit and scope of the invention, the latter being defined by the appended claims.

What is claimed and desired to be secured by Letter Patent of the United States is:

1. A fuel injection valve for internal combustion engines, comprising a valve body (1) and an expansion sleeve (7) surrounding and cooperating with said valve body, a pressure chamber (23) defined between the expansion sleeve (7) and the valve body (1), a high-pressure conduit (27) in said valve body discharges into said pressure chamber and communicates, via an opening cross section that is opened at high pressure between the expansion sleeve (7) and the valve body (1) with an injection cross section opening into the combustion chamber of the engine, the expansion sleeve (7), at least partially surrounds a circumferential jacket face of the valve body (1), and is braced axially against said jacket face, and a portion of the expansion sleeve (7) is embodied as a fastening element on the valve body (1).

2. The fuel injection valve in accordance with claim 1, in which the expansion sleeve (7) is secured by positive, shape-dictated engagement relative to the valve body (1).

3. The fuel injection valve in accordance with claim 1, in which the expansion sleeve (7) is secured by a fixed engagement with the valve body (1).

4. The fuel injection valve in accordance with claim 1, in which the valve body (1) is embodied in one piece.

5. The fuel injection valve in accordance with claim 1, in which an adjusting shim (15) is fastened between an annular step (3) of the valve body (1) and an annular shoulder (13) of the expansion sleeve (7), said shim includes an axial thickness which fixes an axial location of the expansion sleeve (7) on the valve body (1), thus sealing off a pressure chamber (23) between the valve body (1) and the expansion sleeve (7).

6. The fuel injection valve in accordance with claim 1, in which the expansion sleeve (7) is embodied as cup-shaped, and includes a lower, closed end which covers a lower end of the valve body toward the combustion chamber of the valve body (1).

7. The fuel injection valve in accordance with claim 1, in which the openable cross section defining the pressure chamber (23) in a direction of the injection cross section is formed by a sealing edge (21) on the jacket face of the valve body (1) and by a conical valve seat face (17) on the inner wall of the expansion sleeve (7) which cooperates with the valve body.

8. The fuel injection valve in accordance with claim 7, in which the sealing edge (21) on the valve body (1) is formed at a transition between a region of constant diameter and a region of conically narrowing diameter of the valve body (1).

9. The fuel injection valve in accordance with claim 7, in which the sealing edge (21) is formed on the valve body (1) by a radially protruding encompassing annular edge, which is embodied as an annular knife edge.

10. The fuel injection valve in accordance with claim 9, in which the sealing edge (21) is disposed inclined relative to a center axis of the valve body (1).

11. The fuel injection valve in accordance with claim 7, in which the injection cross section is formed by means of at least one injection bore (33) in a wall of the expansion sleeve (7) that adjoins the sealing edge (21) downstream.

12. The fuel injection valve in accordance with claim 1, in which the high-pressure conduit (27) is embodied as an axial blind bore (29), and at least one crosswise bore (31) that discharges into the pressure chamber (23) leads away from said axial blind bore.

13. The fuel injection valve in accordance with claim 1, in which the high-pressure conduit (27) is embodied as an axial through bore (35), which discharges into a pressure chamber (23) located at a bottom of said valve body and defined by a closed end of the expansion sleeve (7).

14. The fuel injection valve in accordance with claim 1, in which the pressure conduit (27) embodied as an axial through bore (35) forms a sealing edge (21) on an outlet opening toward the combustion chamber, said sealing edge cooperates with a conical valve seat (39) disposed on a bottom (19) of the expansion sleeve (7) in such a manner that beyond a certain pressure in the high-pressure conduit (27), the valve seat (39) is displaced axially out of contact with the sealing edge (21) and uncovers the opening cross section between the expansion sleeve (7) and the valve body (1).

15. The fuel injection valve in accordance with claim 1, in which the opening cross section defining the pressure chamber (23) in the direction of at least one the injection bore (33) is formed by a sealing edge (21) on an inner wall of the expansion sleeve (7), which sealing edge cooperates with a conical valve seat face (17) on the jacket face of the valve body (1).

16. The fuel injection valve in accordance with claim 1, in which means are provided by which a location of an expansion sleeve that receives a injection cross section (33) is fixable in a circumference direction.

* * * * *